US009341450B1

(12) United States Patent
Lin

(10) Patent No.: US 9,341,450 B1
(45) Date of Patent: May 17, 2016

(54) HUNTING BROADHEAD

(71) Applicant: Jianhuang Lin, Fujian Province (CN)

(72) Inventor: Jianhuang Lin, Fujian Province (CN)

( * ) Notice: Subject to any disclaimer, the term of this patent is extended or adjusted under 35 U.S.C. 154(b) by 0 days.

(21) Appl. No.: 14/720,972

(22) Filed: May 26, 2015

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | | |
|---|---|---|---|---|---|
| 5,100,143 | A * | 3/1992 | Puckett | F42B 6/08 | 473/583 |
| 7,226,375 | B1 * | 6/2007 | Sanford | F42B 6/08 | 473/583 |
| 7,713,151 | B2 * | 5/2010 | Fulton | F42B 6/08 | 473/583 |
| 8,147,361 | B1 * | 4/2012 | Weaver | F42B 6/08 | 473/583 |
| 8,398,510 | B1 * | 3/2013 | Mizek | F42B 6/08 | 473/583 |
| 8,915,808 | B2 * | 12/2014 | Powell | F42B 12/34 | 473/583 |
| 9,028,349 | B2 * | 5/2015 | Budris | F42B 6/08 | 473/583 |
| 2009/0203477 | A1 * | 8/2009 | Mizek | F42B 6/08 | 473/583 |
| 2015/0105192 | A1 * | 4/2015 | Powell | F42B 12/34 | 473/583 |

* cited by examiner

*Primary Examiner* — John Ricci

(57) ABSTRACT

A hunting broadhead having a tip, a first stem, a middle pin, a first blade, a second blade and a rubber band; a rear end of the tip is riveted to a front end of the first stem; the first stem is provided with a blade slot which accommodates the first blade and the second blade; a stem side flat surface is provided with a middle pin movement slot; a rear end of the middle pin movement slot is provided with a middle pin insertion hole; the first blade and the second blade are removably connected with the first stem via the middle pin; the first blade and the second blade engage with the rubber band provided on a rubber band fixation slot (60) via their respective blade notches (50); a rear end of the first stem (22) is provided with screw threads (67).

6 Claims, 23 Drawing Sheets

HUNTING BROADHEAD

BACKGROUND OF THE INVENTION

The present invention relates to a hunting broadhead which belongs to the technical field of hunting tools.

Apart from capturing wild animals and exploring wildlife resources, hunting may also contribute to wildlife management, ecological balance and healthiness of our bodies. Any use of hunting tools such as snares, clamps, cages, nets, pits, traps, pistols and arrows, or any use of other methods to capture wild animals and to explore wildlife resources may be referred to as hunting. Hunting activities should comply with relevant hunting rules and regulations as stipulated by the laws.

Hunting arrow is a common hunting tool, and a hunting arrowhead is a necessary component of a hunting arrow. The quality of a hunting arrowhead determines the hunting result. A better choice among various common hunting arrowheads is a mechanical broadhead which keeps its blades closed at a certain angle prior to contact with the target and then deploys its blades to swing out upon contact with the target. A mechanical broadhead is usually assembled by screws and it is subject to greater wind deflection along its flight path and is less powerful in terms of its penetration into the target. Therefore, users have greater trouble with changing the blades of the mechanical broadhead and they may be disappointed by a low killing rate.

FIG. 1 shows a mechanical broadhead disclosed by US20100273588A1, comprising a large screw 11, a left blade 12A, a right blade 12B, a front blade 13, a plastic gasket 14, a small screw 15 and a rear end 16. This kind of mechanical broadhead has too many components and it is not convenient, unless by the help of other tools, to replace the left blade 12A, the right blade 12B and the front blade 13. Also, there is a problem of great wind deflection because the left blade 12A and the right blade 12B are not entirely kept within the rear end 16.

BRIEF SUMMARY OF THE INVENTION

In view of the aforesaid disadvantages now present in the prior art, the present invention provides a kind of hunting broadhead which has lesser components and which is more convenient to replace its blades without the need of other aiding tools. Also, the hunting broadhead provided by the present invention is subject to smaller wind deflection and achieves better penetration on the target, thereby giving a high killing rate.

A hunting broadhead comprising a tip, a first stem, a middle pin, a first blade, a second blade and a rubber band.

A rear end of the tip is riveted to a front end of the first stem.

The first stem is provided with a blade slot which accommodates the first blade and the second blade. A stem side flat surface is provided with a middle pin movement slot. A rear end of the middle pin movement slot is provided with a middle pin insertion hole. The first blade and the second blade are removably connected with the first stem via the middle pin. The first blade and the second blade engage with the rubber band provided on a rubber band fixation slot via their respective blade notches.

A rear end of the first stem is provided with screw threads.

In a preferred embodiment, a middle cylinder has a dimension that matches with a dimension of the blade slot of the first stem.

In a preferred embodiment, the middle pin is provided with a pin neck protrusion.

In a preferred embodiment, a head portion of the first blade is provided with a first blade slanted hole, a head portion of the second blade is provided with a second blade slanted hole.

In a preferred embodiment, the head portion of the first blade and the head portion of the second blade are provided with blade jaws respectively.

In a preferred embodiment, thickness of the middle pin corresponds to a width of the middle pin movement slot.

In a preferred embodiment, the middle cylinder is provided at a middle portion of the middle pin. Two ends of a side of the middle pin are provided with sharp edges respectively. Blunt edges are provided respectively between the middle cylinder and one end of the side of the middle pin where one of the sharp edges is provided, and between the middle cylinder and another end of the side of the middle pin where another one of the sharp edges is provided.

A hunting broadhead comprising a tip, a first stem, a short middle pin, a third blade, a fourth blade and a rubber band.

A rear end of the tip is riveted to a front end of the first stem.

The first stem is provided with a blade slot which accommodates the third blade and the fourth blade. A stem side flat surface is provided with a middle pin movement slot. A rear end of the middle pin movement slot is provided with a middle pin insertion hole. The third blade and the fourth blade are removably connected with the first stem via the short middle pin. The third blade and the fourth blade engage with the rubber band provided on a rubber band fixation slot via their respective blade notches.

A rear end of the first stem is provided with screw threads.

In a preferred embodiment, the tip and the first stem are integrated as a whole.

The present invention has the following advantages:

1. The present invention has lesser components;
2. The present invention facilitates simple replacement of blades without the need of other aiding tools; and
3. The present invention is subject to smaller wind deflection and has stronger penetrating power, thereby having higher killing rate.

REFERENCE SIGNS

Figure 1A:
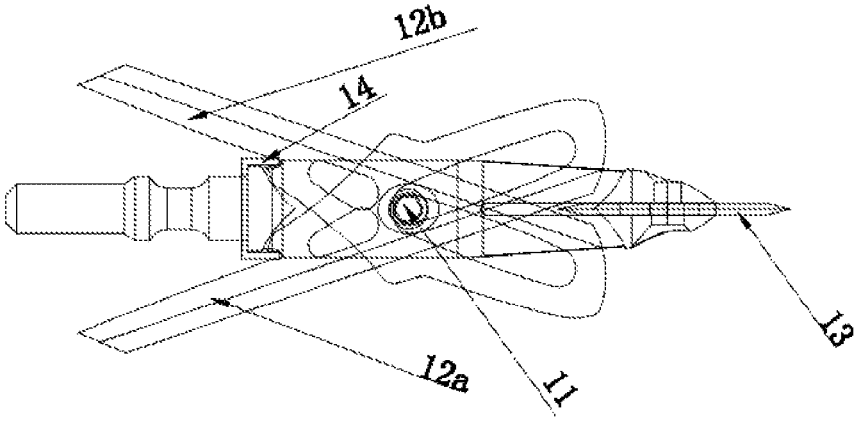
FIG.1a Prior Art
FIG. 1*a* is a front view of an existing mechanical broadhead.
Figure 1B:
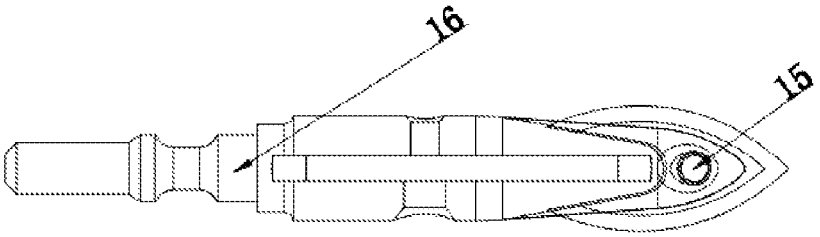
FIG.1b Prior Art
FIG. 1*b* is a side view of FIG. 1*a*.

11—large screw 12A—left blade
12B—right blade 13—front blade
14—plastic gasket 15—small screw
16—rear end 21A—first blade
21B—second blade 22—first stem
23—middle pin 24—tip
25—rubber band
50—blade notches 51—upper points
52—lower points 53—blade jaws
54—blade shoulders 55—pin through hole
60—rubber band fixation slot 61—blade slot
62—middle pin insertion hole 63—middle pin movement slot
64—middle pin movement slot front section 65—stem side flat surface
66—tip insertion hole 67—screw threads
68—front end 69—first stem shoulder portion
70—sharp edges 71—blunt edges
72—pin neck protrusion 73—middle cylinder
74—middle pin rear end 75—middle pin front end
81—threaded portion 82—tip face
91—integral stem 92—short middle pin
93A—third blade 93B—fourth blade
101—first blade slanted hole 102—second blade slanted hole
50*a*—third blade notch 55*a*—third blade pin through hole
94—third blade and fourth blade rear portions 95*a*—fifth blade
95*b*—sixth blade 50*b*—fifth blade and sixth blade notches

DETAILED DESCRIPTION OF THE INVENTION

A detailed description of the present invention is given below.

Embodiment 1

As shown in FIG. 2 to FIG. 11*d*, a hunting broadhead comprises a tip 24, a first stem 22, a middle pin 23, a first blade 21A, a second blade 21B and a rubber band 25.

A rear end of the tip 24 is riveted to a front end of the first stem 22.

The first stem 22 is provided with a blade slot 61 which accommodates the first blade 21A and the second blade 21B. A stem side flat surface 65 is provided with a middle pin movement slot 63. A rear end of the middle pin movement slot 63 is provided with a middle pin insertion hole 62. The first blade 21A and the second blade 21B are removably connected with the first stem 22 via the middle pin 23. The first blade 21A and the second blade 21B engage with the rubber band 25 provided on a rubber band fixation slot 60 via their respective blade notches 50.

A rear end of the first stem 22 is provided with screw threads 67.

In the present embodiment, the tip 24 and the first stem 22 are structured as a one whole piece.

In the present embodiment, a middle cylinder 73 has a dimension that matches with the dimension of the blade slot 61 of the first stem 22.

In the present embodiment, the middle pin 23 is provided with a pin neck protrusion 72.

In the present embodiment, a head portion of the first blade 21A is provided with a first blade slanted hole 101, a head portion of the second blade 21B is provided with a second blade slanted hole 102.

In the present embodiment, the head portion of the first blade 21A and the head portion of the second blade 21B are provided with blade jaws 53 respectively.

In the present embodiment, thickness of the middle pin 23 corresponds to the width of the middle pin movement slot 63.

In the present embodiment, the middle cylinder 73 is provided at a middle portion of the middle pin 23. Two ends of a side of the middle pin 23 are provided with sharp edges 70 respectively.

Figure 2:
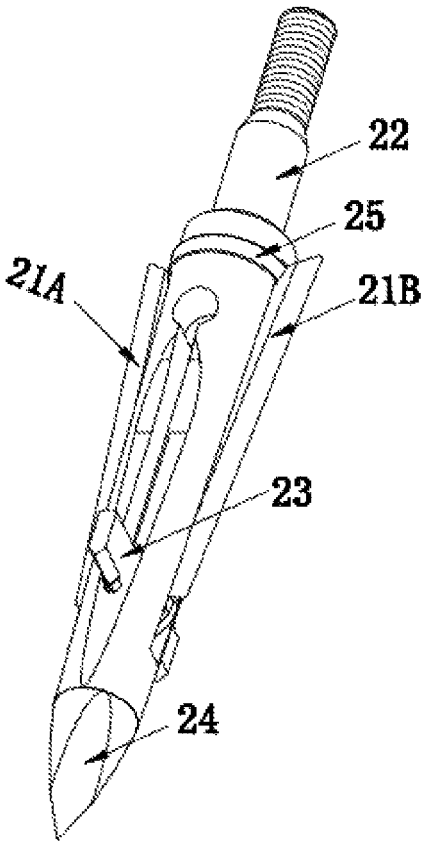
FIG. 2 is a schematic view showing a closed condition of the hunting broadhead of the present invention.

As shown in FIG. 2, the tip 24 is riveted to the front end of the first stem 22. In general, the tip must be sharp to ensure better penetration. Rivet connection is a kind of tight connection so that the tip will not become loose during the course of use.

Figure 8A:
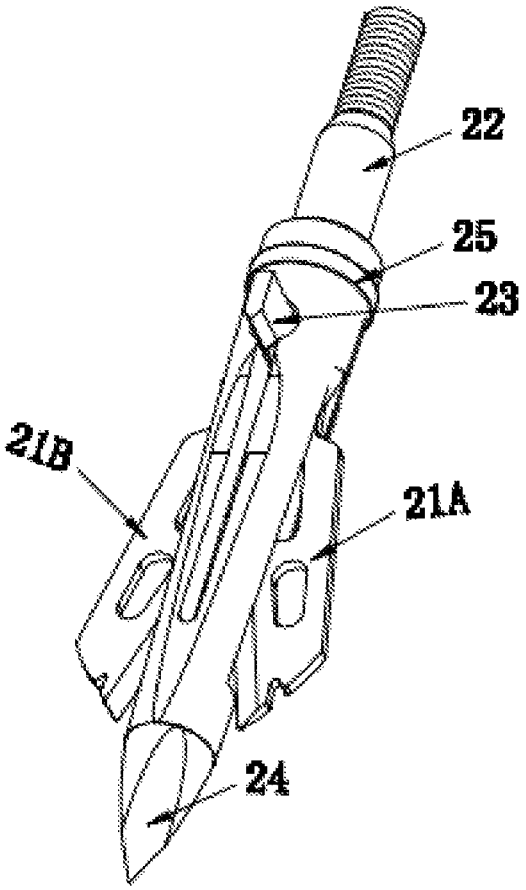
FIG. 8*a* is a perspective view showing a blade mounting condition of the hunting broadhead of the present invention.
Figure 8B:
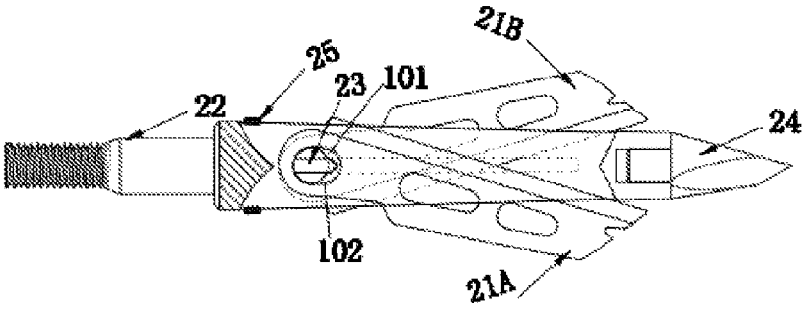
FIG. 8*b* is a front sectional view showing a blade mounting condition of the hunting broadhead of the present invention.

As shown in FIG. 8*b*, the first blade 21A and the second blade 21B partially overlap with each other in the blade slot 61 of the first stem 22 and thus forming an angle with respect to each other so that the first blade slanted hole 101 and the second blade slanted hole 102 entirely overlap with each other forming a largest possible through hole through which the middle pin 23 can easily pass through the first blade 21A, the second blade 21B and the first stem 22 to complete the assembly of the first blade 21A, the second blade 21B and the first stem 22. This kind of assembly can be accomplished without the help of other tools and thus facilitate simpler replacement of the blades.

Figure 10A:
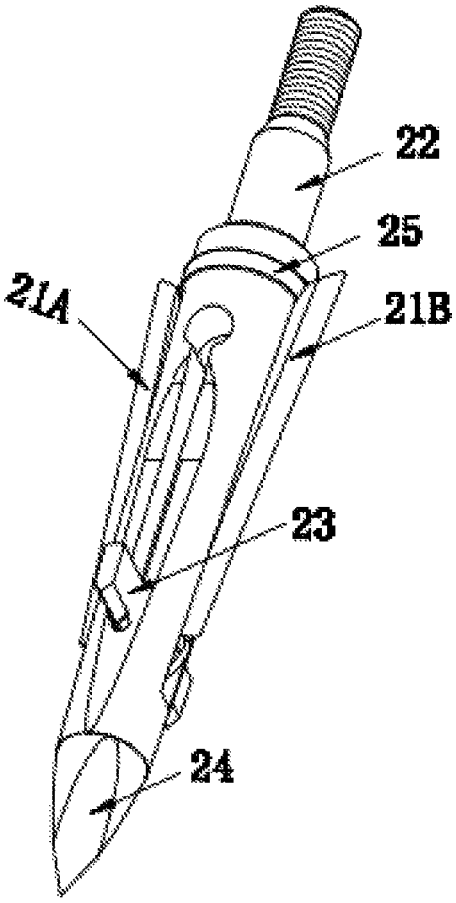
FIG. 10*a* is a perspective view showing a closed condition of the hunting broadhead of the present invention.
Figure 10B:
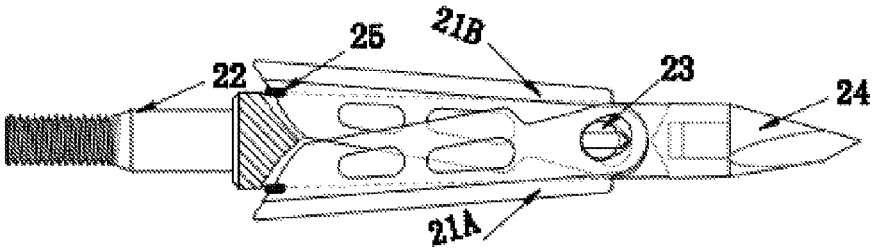
FIG. 10*b* is a front sectional view showing a closed condition of the hunting broadhead of the present invention.
Figure 10C:
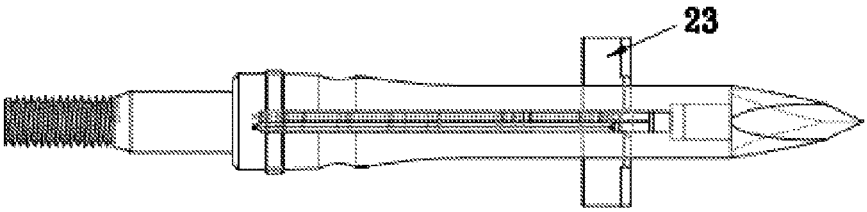
FIG. 10*c* is a side view showing a closed condition of the hunting broadhead of the present invention.
Figure 10D:
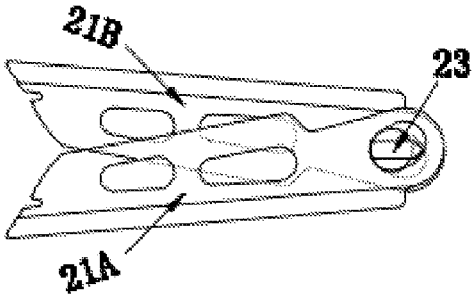
FIG. 10*d* is a partial view showing a closed condition of the hunting broadhead of the present invention.

As shown in FIG. 10*b*, the middle pin 23 is pulled forward and thereby pulling also the first blade 21A and the second blade 21B such that in a closed condition of the first blade 21A and the second blade 21B of the hunting broadhead, the first blade 21A and the second blade 21B are fixed to the first stem 22 where they are in a substantially overlapped position with respect to each other forming just a small angle with respect to each other. The rubber band 25 is fitted on the first stem 22. Resilience of the rubber band 25 keeps the first blade 21A and the second blade 21B in the substantially overlapped position so that the first blade 21A and the second blade 21B will not swing out. This design can maximally keep the blades in the closed condition before the hunting broadhead hits the target so that the hunting broadhead is subject to less wind deflection during its flight path.

Figure 5A:
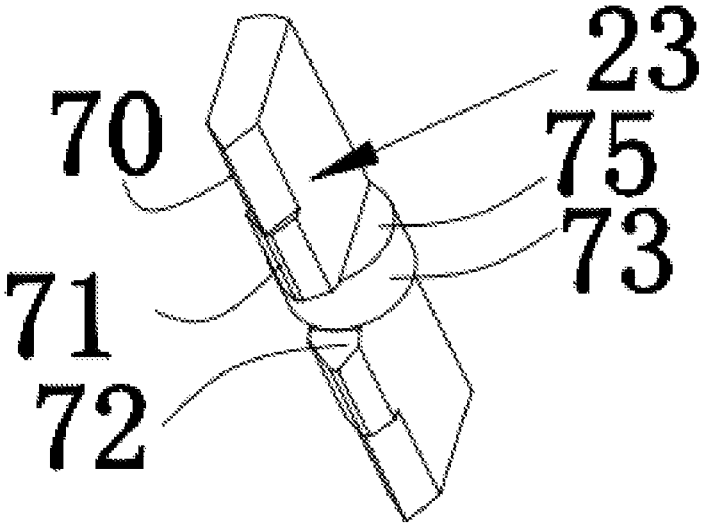
FIG. 5*a* is a perspective view of the middle pin of the hunting broadhead of the present invention.
Figure 5B:
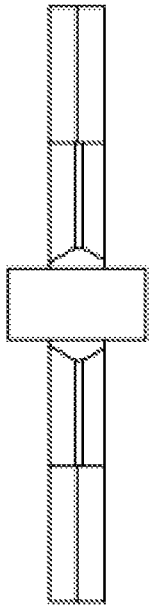
FIG. 5*b* is a front view of the middle pin of the hunting broadhead of the present invention.
Figure 5C:
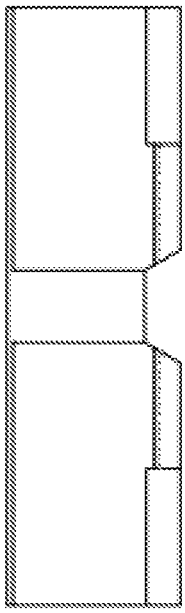
FIG. 5*c* is a left side view of the middle pin of the hunting broadhead of the present invention.
Figure 11A:
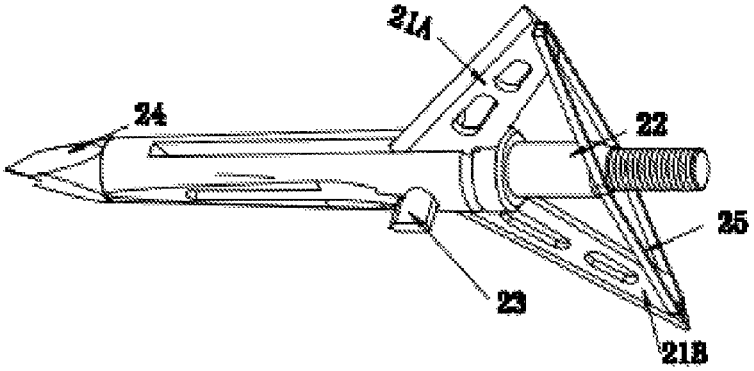
FIG. 11*a* is a perspective view showing an opened condition of the hunting broadhead of the present invention.
Figure 11B:
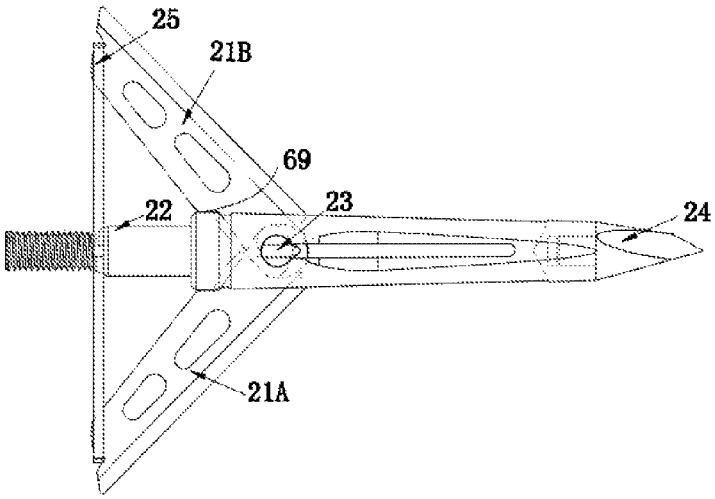
FIG. 11*b* is a front view showing an opened condition of the hunting broadhead of the present invention.
Figure 11C:
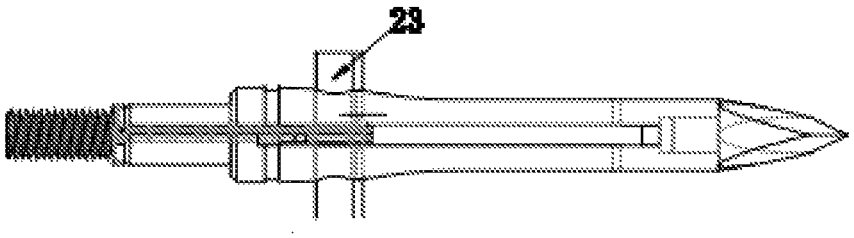
FIG. 11*c* is a side view showing an opened condition of the hunting broadhead of the present invention.
Figure 11D:
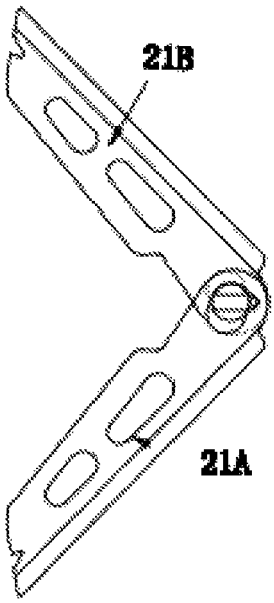
FIG. 11*d* is a partial view showing an opened condition of the hunting broadhead of the present invention.

As shown in FIG. 11*b*, when the hunting broadhead hits the target, reactional force created by the hunting broadhead upon hitting the target will push the middle pin 23 backward, and then the middle pin 23 will drive the first blade 21A and the second blade 21B to swing out. When the middle pin 23 is being pushed backward to a rear end of the middle pin movement slot 63 along the middle pin movement slot 63 on the first stem 22, the first blade 21A and the second blade 21B rest on a first stem shoulder portion 69 of the first stem 22 so that the first blade 21A and the second blade 21B swing out to a predetermined angle. In general, as shown in FIG. 5*a*, blunt edges 71 are also provided on the same side of the middle pin 23 where sharp edges 70 are provided. In particular, since the first stem 22 has a greater diameter at the middle pin insertion hole 62 compared to a front end of the first stem 22, the blunt edges 71 are concealed within the first stem when the middle pin 23 is being pushed backward to the middle pin insertion hole 32 so as to ensure that the blades will be driven backward to prevent the hunting broadhead from hitting into the target before the blades swing out. As such, penetration power of the broadhead will not be affected. If the blades can swing out to a predetermined angle prior to the broadhead hitting the target, a larger wound can be created on the target when the broadhead hits the target.

The hunting broadhead of the present invention uses the middle pin 23 (as shown in FIG. 2) in lieu of screws commonly used in prior art. This design can facilitate simpler and easier replacement of the first blade 21A and the second blade 21B.

Figure 3A:
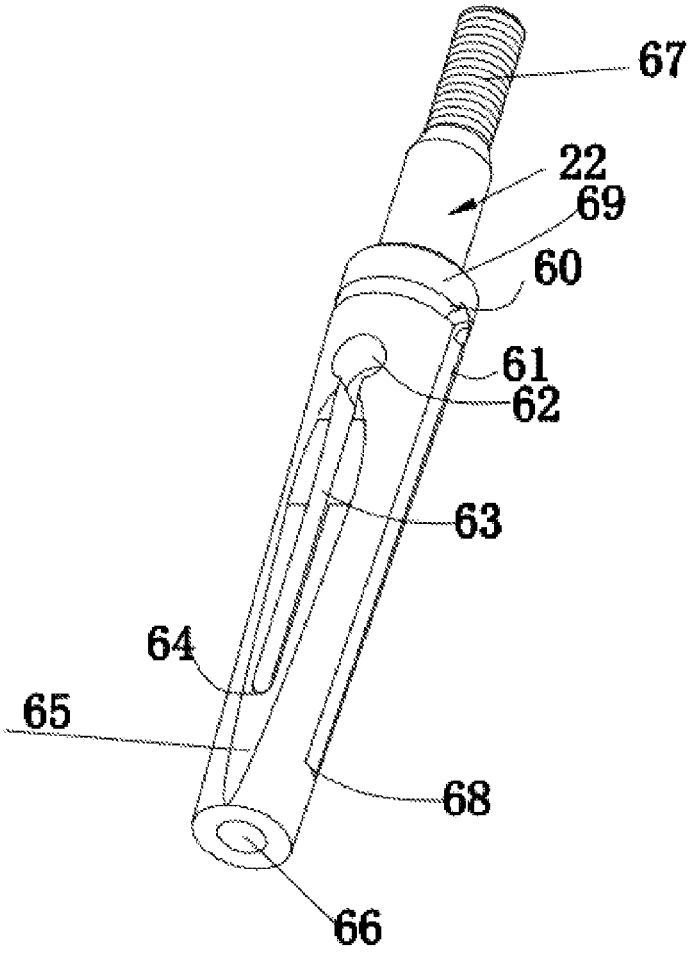
FIG. 3*a* is a perspective view of the first stem of the hunting broadhead of the present invention.
Figure 3B:
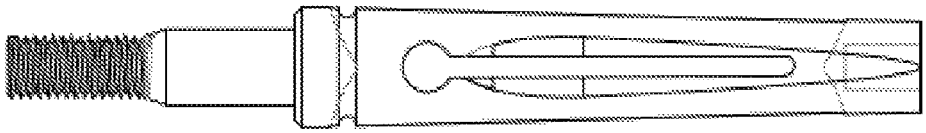
FIG. 3*b* is a front view of the first stem of the hunting broadhead of the present invention.
Figure 3C:
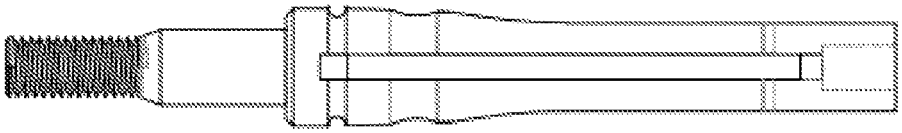
FIG. 3*c* is a side view of the first stem of the hunting broadhead of the present invention.

As shown in FIGS. 3*a* to 3*c*, the screw threads 67 are provided on the rear end of the hunting broadhead. The rubber band fixation slot 60 is used for fixing the rubber band 25 which is in a closed condition as shown in FIG. 2. The rubber band 25 keeps the first blade 21A and the second blade 21B in the closed condition, in particular, when the first blade 21A and the second blade 21B are in the closed condition, the rubber band 25 fixes the first blade 21A and the second blade 21B to the first stem 22 via the respective blade notches 50 of the first blade 21A and the second blade 21B. Size of the middle pin movement slot 63 must match with the width of the middle pin 23 so that the middle pin 23 can slide freely in the middle pin movement slot 63. The middle pin insertion hole 62 ensures smooth mounting process of the middle pin 23, as shown in FIG. 8*a*. When the middle pin 23 moves to a middle pin movement slot front section 64 and the blunt edges 71 of the middle pin 23 abut against the middle pin movement slot front section 64, the first blade and the second blade are moved to the closed condition where they are fixed at the closed condition via the rubber band 25, and a closing angle is formed between each of the blades and the first stem in this closed condition (FIG. 2). In the closed condition of the blades, since the first stem 22 has a smaller diameter at the middle pin movement slot front section 64 compared to its diameter at the middle pin insertion hole, the blunt edges 71 on the middle pin 23 are partially exposed so that when the hunting broadhead hits the target, the hunting broadhead will have greater penetrating power and the blades will swing out quickly. The rubber band fixation slot 60 engages with the rubber band 25, and the rubber band 25 also engages with the respective blade slots 50 of the first blade 21A and the second blade 21B, as shown in FIG. 10*b*, so that the first blade 21A and the second blade 21B are in the closed condition during flight of the hunting broadhead. A tip insertion hole 66 on the first stem 22 is tightly fitted with a threaded portion 81 of the tip 24.

Figure 4:
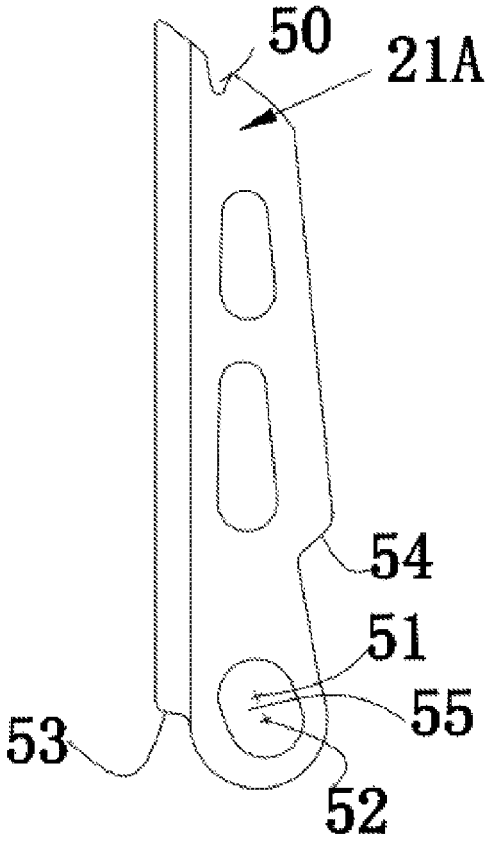
FIG. 4 is a schematic view of the first blade of the hunting broadhead of the present invention.
Figure 5D:
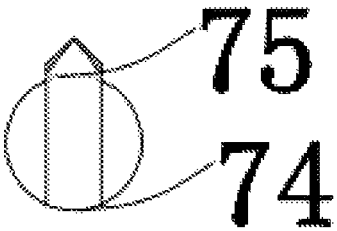
FIG. 5*d* is a top plan view of the middle pin of the hunting broadhead of the present invention.
Figure 6A:
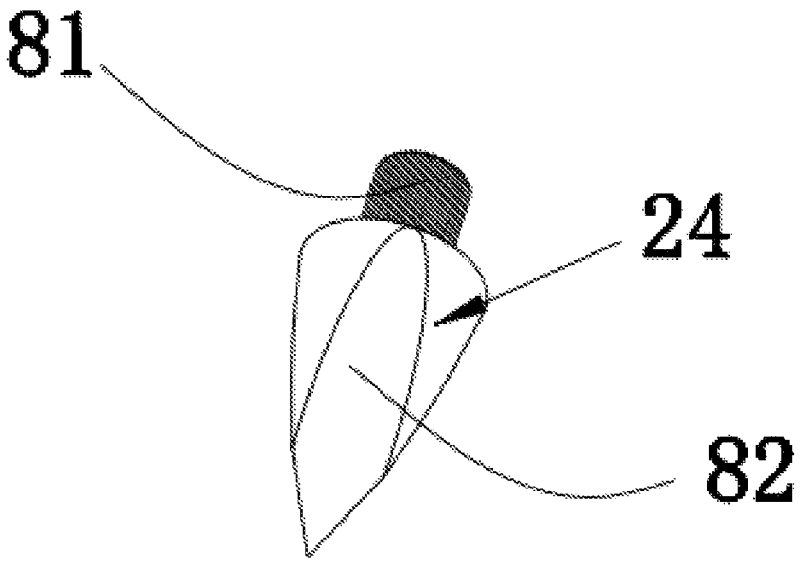
FIG. 6*a* is a perspective view of the tip of the hunting broadhead of the present invention.
Figure 6B:
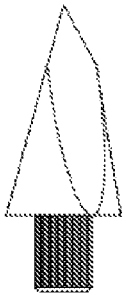
FIG. 6*b* is a front view of the tip of the hunting broadhead of the present invention.
Figure 6C:
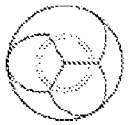
FIG. 6*c* is a top plan view of the tip of the hunting broadhead of the present invention.
Figure 6D:
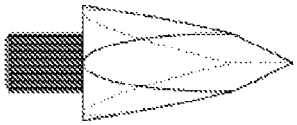
FIG. 6*d* is a side view of the tip of the hunting broadhead of the present invention.

As shown in FIGS. 2, 4 and 5*d*, when the broadhead is in a closed condition, respective upper points 51 within the first blade slanted hole 101 and the second blade slanted hole 102 are in contact with a middle pin rear end 74. The first blade slanted hole 101 and the second blade slanted hole 102 are each in an oval shape.

As shown in FIGS. 4, 5*d*, 8*b* and 11 *b*, when the broadhead is in a blade mounting condition and in an opened condition, respective lower points 52 within the first blade slanted hole 101 and the second blade slanted hole 102 are in contact with a middle pin front end 75. The first blade slanted hole 101 and the second blade slanted hole 102 are each in an oval shape.

Figure 8C:
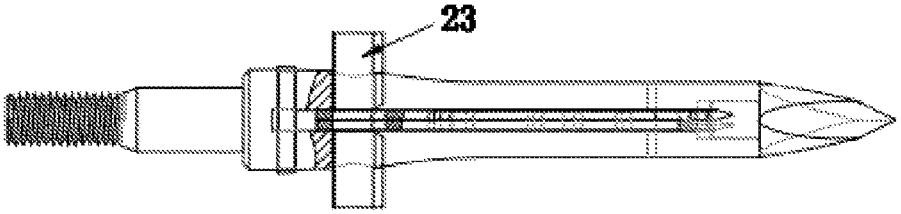
FIG. 8*c* is a side view showing a blade mounting condition of the hunting broadhead of the present invention.
Figure 9A:
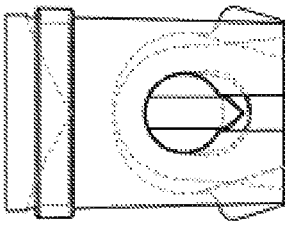
FIG. 9*a* is a partial front view showing a blade mounting condition of the hunting broadhead of the present invention.
Figure 9B:
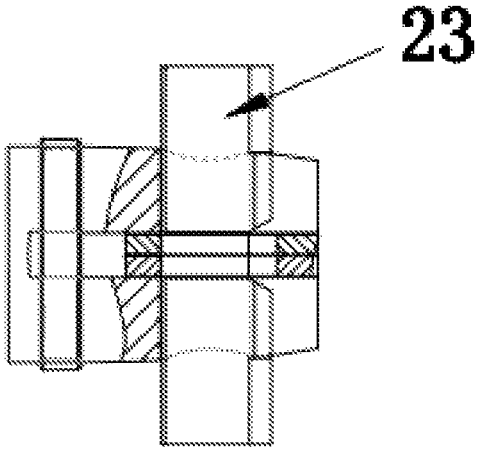
FIG. 9*b* is a partial side sectional view showing a blade mounting condition of the hunting broadhead of the present invention.

The first blade slanted hole 101 and the second blade slanted hole 102 within which there are respective upper points 51 and respective lower points 52 allow the middle pin 23 to pass through them easily, as shown in FIGS. 8*a* to 8*c*.

The blade jaws 53 serve an assistant propelling purpose during the process which the hunting broadhead pierces into the target. As shown in FIGS. 11*a* to 11*d*, respective blade shoulders 54 of the first blade 21A and the second blade 21B rest on a first stem shoulder portion 69 of the first stem 22 when the first blade 21A and the second blade 21B are in opened condition so that the first blade 21A and the second blade 21B swing out and are being fixed. The blade notches 50 engage with the rubber band 25 continuously from the closed condition of the broadhead to the opened condition of the broadhead so as to fix the respective positions of the first blade 21A and the second blade 21B in both the closed condition and the opened condition of the broadhead.

Figure 7:
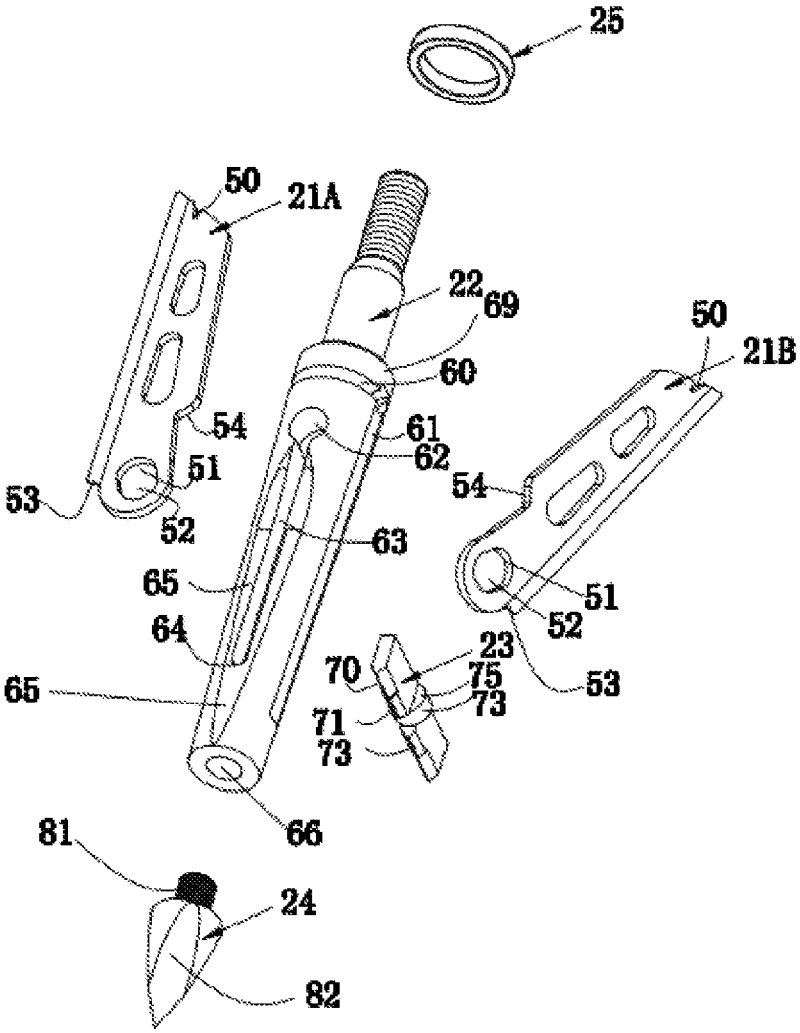
FIG. 7 is an exploded view of the hunting broadhead of the present invention.

As shown in FIGS. 5*a* to 5*d*, the middle cylinder 73 can pass through the first blade 21A and the second blade 21B, and it is slidable freely in the blade slot 61 and can fall off therefrom (FIG. 7). The middle pin 23 is provided with sharp edges 70 to ensure wound infliction and blunt edges 71 to ensure propelling force. The pin neck protrusion 72 can be held by the first blade 21A and the second blade 21B when the broadhead is in an opened condition so that the middle pin 23 will not fall off.

As shown in FIG. 6, the tip 24 has the threaded portion 81. The threaded portion 81 is tightly inserted into the tip insertion hole 66 on the first stem 22. The tip has a tip face 82 which has three equally and evenly cut sections to ensure sharpness of the tip 24.

As shown in FIGS. 8*a* to 8*b*, when a certain angle is formed between the first blade 21A and the second blade 21B, the first blade slanted hole 101 and the second blade slanted hole 102 form a through hole which the middle pin 23 can easily pass through to facilitate assembly. When in another situation as shown in FIG. 11*b*, another angle is formed between the first blade 21A and the second blade 21B, the first blade slanted hole 101 and the second blade slanted hole 102 also form an angle with respective to each other to hold the middle pin 23 so that the middle pin 23 will not fall off.

Embodiment 2

As shown in FIGS. 12*a* to 13*c*, embodiment 2 is the same as embodiment 1, except as follows:

An integral stem 91 is used in embodiment 2 to replace the first stem 22 and the tip 24 used in embodiment 1. The integral stem 91 integrates the first stem 22 and the tip 24 in a one whole piece so that the hunting broadhead is constructed more integrally and empowered with stronger penetrating force. A short middle pin 92 is used in embodiment 2 in lieu of the middle pin 23 used in embodiment 1 to increase penetrating force. A third blade 93A and a fourth blade 93B are used in embodiment 2 in lieu of the first and second blades 21A, 21B in embodiment 1; by pushing the third blade and fourth blade rear portions 94, the third blade 93A and the fourth blade 93B swing out.

Figure 12A:
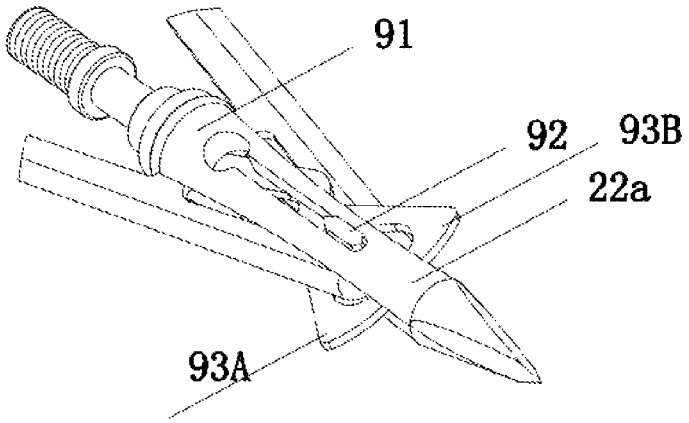
FIG. 12*a* is a perspective view showing a closed condition of the hunting broadhead according to a second embodiment.
Figure 12B:
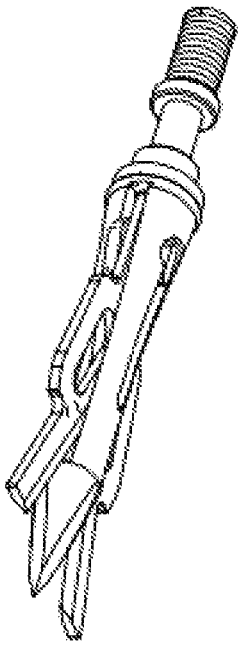
FIG. 12*b* is a perspective view showing a blade mounting condition of the hunting broadhead according to a second embodiment.
Figure 12C:
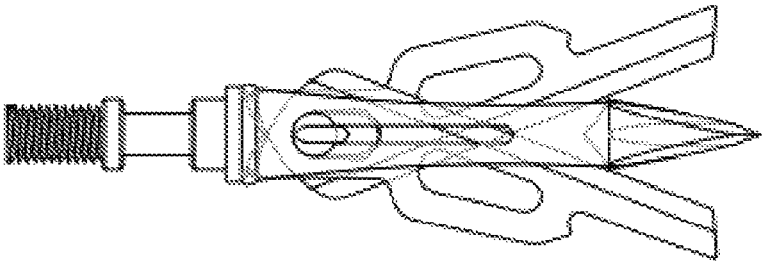
FIG. 12*c* is a front view showing a blade mounting condition of the hunting broadhead according to a second embodiment.
Figure 12D:
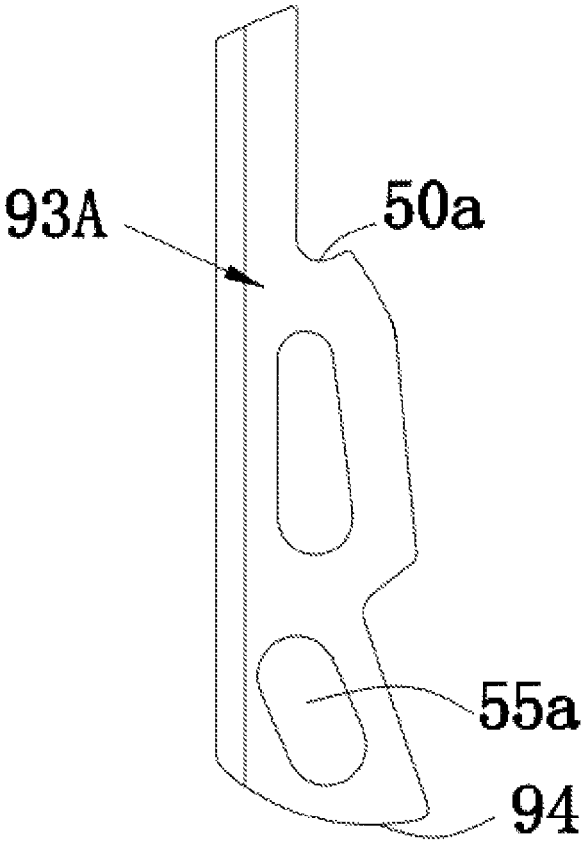
FIG. 12*d* is a front view showing a third blade of the hunting broadhead according to a second embodiment.
Figure 12E:
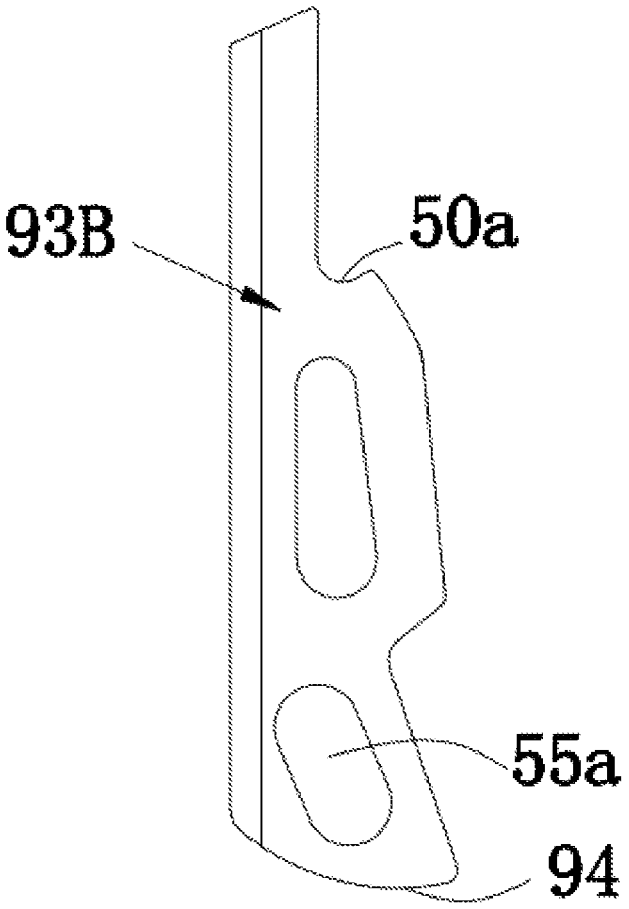
FIG. 12*e* is a front view showing a fourth blade of the hunting broadhead according to a second embodiment.
Figure 13A:
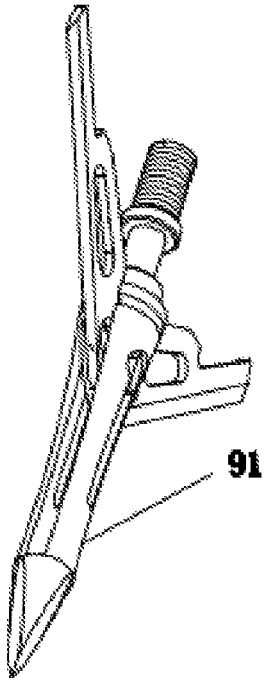
FIG. 13*a* is a perspective view showing an opened condition of the hunting broadhead according to a second embodiment.
Figure 13B:
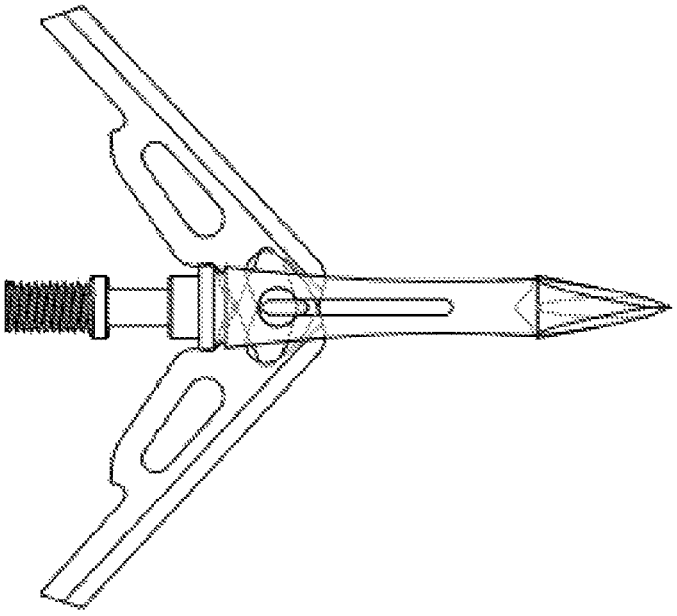
FIG. 13*b* is a front view showing an opened condition of the hunting broadhead according to a second embodiment.
Figure 13C:
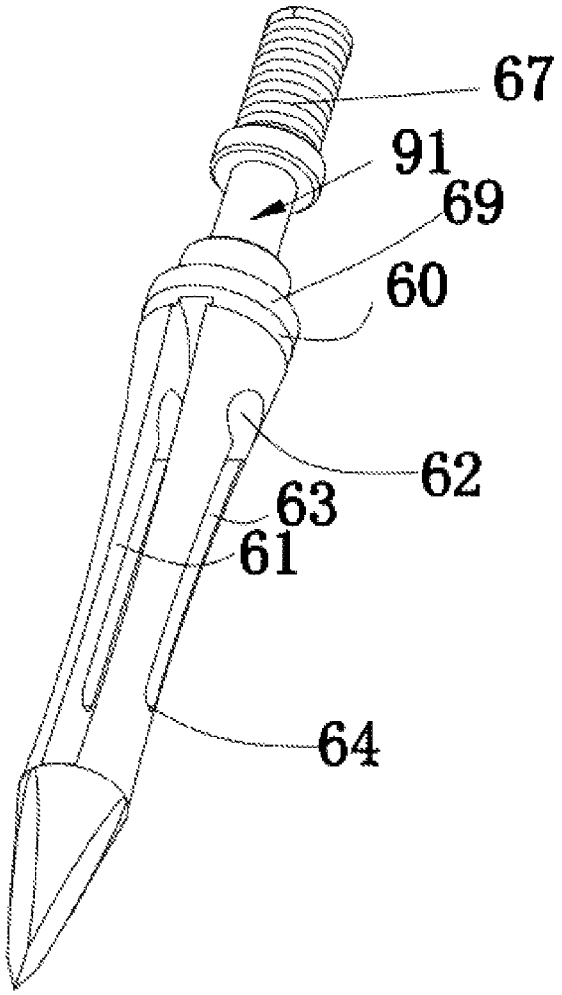
FIG. 13*c* is a perspective view showing the integral stem of the hunting broadhead according to a second embodiment.
Figure 14A:
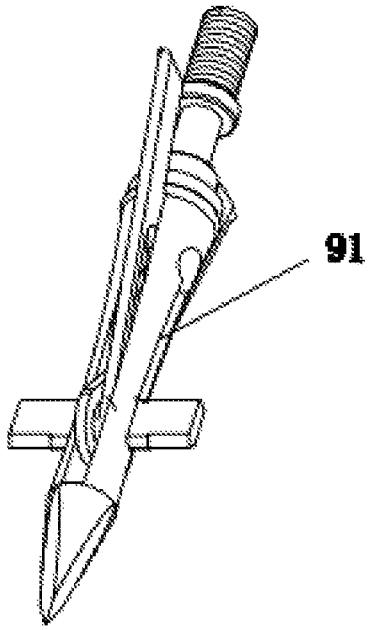
FIG. 14*a* is a perspective view showing a closed condition of the hunting broadhead according to a third embodiment.
Figure 14B:
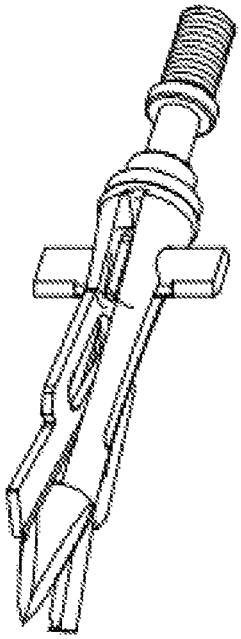
FIG. 14*b* is a perspective view showing a blade mounting condition of the hunting broadhead according to a third embodiment.
Figure 14C:
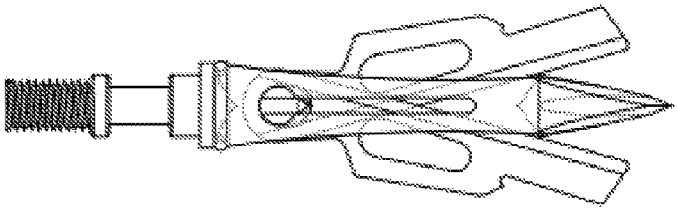
FIG. 14*c* is a front view showing a blade mounting condition of the hunting broadhead according to a third embodiment.
Figure 14D:
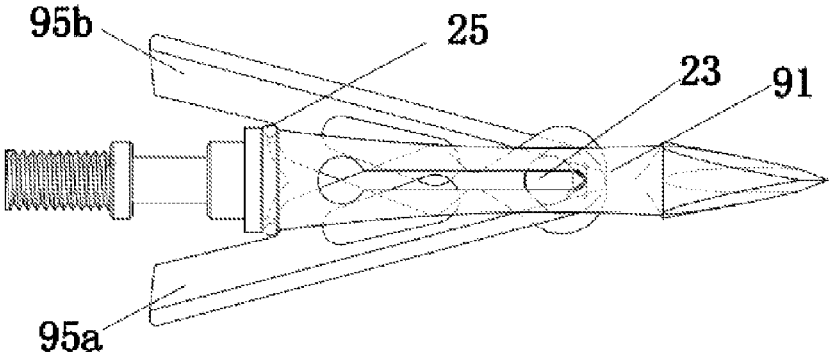
FIG. 14*d* is a front view showing a closed condition of the hunting broadhead according to a third embodiment.

As shown in FIG. 12*d*, the third blade 93A and the fourth blade 93B are different from the first and the second blade 21A, 21B in that blade notches and pin through holes of the third and the fourth blades 93A, 93B are positioned differently compared with the blade notches and pin through holes of the first and the second blade 21A, 21B; and the overall structure of the third and the fourth blades 93A, 93B are different from the overall structure of the first and the second blade 21A, 21B.

Embodiment 3

Embodiment 3 is the same as embodiment 1, except as follows:

As shown in FIGS. 14*a* to 15*c*, an integral stem 91 is used in embodiment 3 to replace the first stem 22 and the tip 24 used in embodiment 1. The integral stem 91 integrates the first stem 22 and the tip 24 in a one whole piece so that the hunting broadhead is constructed more integrally and empowered with stronger penetrating force. A fifth blade 95A and a sixth blade 95B are used in embodiment 3 in lieu of the first blade 21A and the second blade 21B in embodiment 1.

Figure 15A:
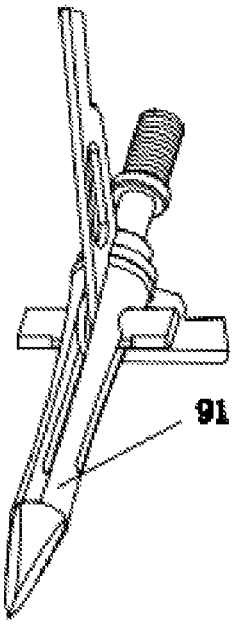
FIG. 15*a* is a perspective view showing an opened condition of the hunting broadhead according to a third embodiment.
Figure 15B:
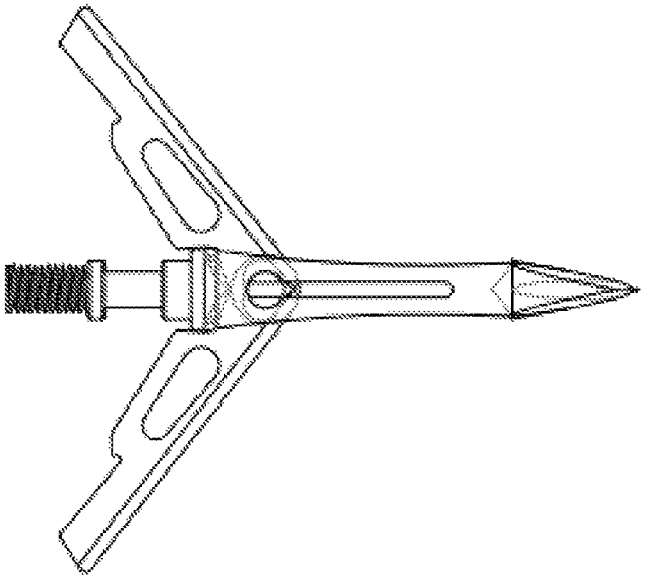
FIG. 15*b* is a front view showing an opened condition of the hunting broadhead according to a third embodiment.
Figure 15C:
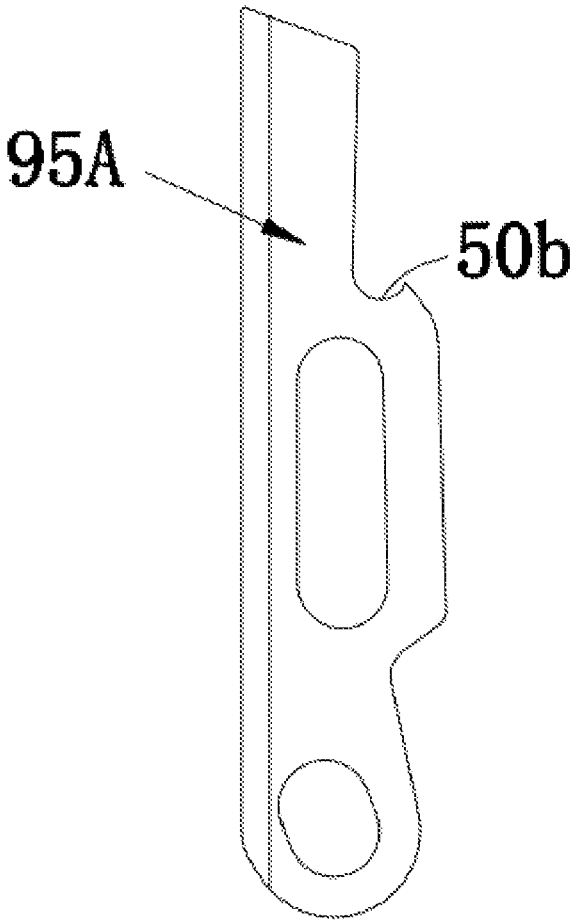
FIG. 15*c* is a front view of a blade of the hunting broadhead according to a third embodiment.

The fifth blade 95A and the sixth blade 95B are different from the first blade 21A and the second blade 21B in that blade notches of the fifth and the sixth blades 95A, 95B are positioned differently compared with the blade notches of the first and the second blade 21A, 21B; the fifth blade 95A and the sixth blade 95B do not have any blade jaws, and also their overall structures as shown in FIG. 15*c* are different from that of the first and the second blades 21A, 21B.

The embodiments of the present invention are described in detail below. However, the present invention should not be limited to the above embodiments. Any changes to the present invention may be made based on the technical knowledge known to any person skilled in this field of art without deviating from the scope of the present invention.

What is claimed is:

1. A hunting broadhead comprising a tip (24), a first stem (22), a middle pin (23), a first blade (21A), a second blade (21B) and a rubber band (25); a rear end of the tip (24) is riveted to a front end of the first stem (22); the first stem (22) is provided with a blade slot (61) which accommodates the first blade (21A) and the second blade (21B); a stem side flat surface (65) is provided with a middle pin movement slot (63); a rear end of the middle pin movement slot (63) is provided with a middle pin insertion hole (62); the first blade (21A) and the second blade (21B) are removably connected with the first stem (22) via the middle pin (23); the first blade (21A) and the second blade (21B) engage with the rubber band (25) provided on a rubber band fixation slot (60) via respective blade notches (50) of the first blade (21A) and the second blade (21B); a rear end of the first stem (22) is provided with screw threads (67); a middle cylinder (73) is provided at a middle portion of the middle pin (23); two ends of a side of the middle pin (23) are provided with sharp edges (70) respectively; blunt edges (71) are provided respectively between the middle cylinder (73) and one end of the side of the middle pin (23) where one of the sharp edges (70) is provided, and between the middle cylinder (73) and another end of the side of the middle pin (23) where another one of the sharp edges (70) is provided.

2. The hunting broadhead according to claim 1, wherein thickness of the middle pin (23) corresponds to width of the middle pin movement slot (63).

3. The hunting broadhead according to claim 1, wherein the middle cylinder (73) has a dimension that matches with a dimension of the blade slot (61) of the first stem (22).

4. The hunting broadhead according to claim 1, wherein the middle pin (23) is provided with a pin neck protrusion (72).

5. The hunting broadhead according to claim 1, wherein a head portion of the first blade (21A) is provided with a first blade slanted hole (101), a head portion of the second blade (21B) is provided with a second blade slanted hole (102).

6. The hunting broadhead according to claim 1, wherein a head portion of the first blade and a head portion of the second blade are provided with blade jaws respectively.

* * * * *